US006447187B1

(12) United States Patent
Robinson

(10) Patent No.: US 6,447,187 B1
(45) Date of Patent: Sep. 10, 2002

(54) RESTRAINING MODULE FOR A CUTTER OF A PRINTER

(75) Inventor: Carl Wesley Robinson, Charlotte, NC (US)

(73) Assignee: XAC Automation Corporation, Hsinchu (TW)

( * ) Notice: Subject to any disclaimer, the term of this patent is extended or adjusted under 35 U.S.C. 154(b) by 92 days.

(21) Appl. No.: 09/695,318

(22) Filed: Oct. 25, 2000

(51) Int. Cl.[7] ..... B26D 5/08

(52) U.S. Cl. ..... 400/621; 400/593; 83/564; 83/588; 83/633; 83/636

(58) Field of Search ..... 400/621, 593; 83/588, 601, 602, 605, 627, 628, 631, 633, 636, 564, 563

(56) References Cited

U.S. PATENT DOCUMENTS

| | | | | |
|---|---|---|---|---|
| 5,727,889 A | * | 3/1998 | Koyabu | 400/621 |
| 5,833,380 A | | 11/1998 | Hosomi et al. | |
| 6,361,231 B1 | * | 3/2002 | Sato et al. | 400/120.16 |

FOREIGN PATENT DOCUMENTS

| | | |
|---|---|---|
| JP | 54-123482 | 8/1979 |
| JP | 2-10953 | 1/1990 |
| JP | 6-238970 | 8/1994 |

* cited by examiner

*Primary Examiner*—Andrew H. Hirshfeld
*Assistant Examiner*—Kevin D. Williams
(74) *Attorney, Agent, or Firm*—Sughrue Mion, PLLC

(57) ABSTRACT

Disclosed is a printer having: a fixed chassis mounted thereon; a moving chassis being engageable with the fixed chassis between an open position and a closed position; a cutter including a fixed blade and a moving blade; a paper drive roll; a thermal head; and driving means driving the paper drive roll to subject paper rolling along a paper path formed between the thermal head and the paper drive roll, and the fixed blade and moving blade; wherein the thermal head is in a path of the paper drive roll and wherein the moving blade urges the fixed blade towards the fixed chassis when the moving chassis is at the closed position, and a restraining module for maintaining an appropriate gap between the fixed blade and the moving blade when the moving chassis is engaging the fixed chassis.

6 Claims, 6 Drawing Sheets

RESTRAINING MODULE FOR A CUTTER OF A PRINTER

FIELD OF INVENTION

The present invention relates to a printer suitable, for example, for use with electronic cash registers used in point-of-sale (POS) systems and relates, more particularly, to a printer comprising a restraining module for its cutter having a moving blade and a fixed blade so as to maintain an appropriate gap between the moving blade and the fixed blade when the printer moving is approaching the closed position thereby allowing smooth engagement of the fixed and moving blades.

BACKGROUND OF INVENTION

Printers used in point-of-sale (POS) systems generally print to rolled paper as the recording medium using a thermal head or other type of print head, and comprise a cutter to cut the printed paper to obtain a sales receipt that can be handed to the customer.

Typical of the various cutters employed in such printers are cutters that cut the paper by pushing a cutting blade perpendicularly against the paper as described in JP-A-238970/1994, and cutters that cut the recording paper using a fixed blade and a moving blade as described in JP-U-123482/1979. A scissors-type cutter that cuts the recording paper by moving a moving blade across the paper while cutting the recording paper from one edge to the other is also known as described in JP-U-10953/1990, and U.S. Pat. No. 5,833,380.

In such conventional printers, while engaging the moving blade to the fixed blade, the moving blade is constantly pressed unto the fixed blade during the entire engagement process. Such an engagement manner thus easily result in damages and scratches of either the moving blade or the fixed blade such that after multiple engagement, cutting edges of the moving blade and the fixed blade may be dull and thus require replacement or re-sharpening.

It is thus needed to design a restraining module for a cutter of a printer, that restrains the moving blade from contacting the fixed blade prior to complete engagement of the two blades so as to allow smooth engagement, but provides sufficient force subjecting the two blades to work closely to one another so as to provide neat cutting results.

SUMMARY OF INVENTION

The object of the present invention is to provide a restraining module for a cutter of a printer overcoming the problems of the prior art as described above and being able to prevent from damaging the fixed or moving blade during engagement of the two.

It is a further object of this invention to provide a restraining module for a cutter of a printer that implements obstruction between a moving chassis and a fixed chassis of the printer prior to the printer reaching its closed position so as to prevent the moving blade from contacting the fixed blade prior to their full engagement.

Another object of the present invention is to provide a printer including such a restraining module for a cutter.

To achieve the above objects, disclosed is a printer having a restraining module for a cutter thereof, the printer including: a fixed chassis; a moving chassis being engageable with the fixed chassis between an open position and a closed position; the cutter including a fixed blade and a moving blade being pivotally mounted to the moving chassis; a paper drive roll; a thermal head; and driving means driving the paper drive roll to subject paper rolling between the thermal head and the paper drive roll and then between the fixed blade and moving blade; wherein the thermal head is in a path of the paper drive roll and wherein the moving blade presses and urges the fixed blade towards the fixed chassis when the moving chassis is at the closed position, the restraining module comprising: a first angle control means mounted at the fixed chassis normally forcing the fixed blade to incline away from the fixed chassis; and a second angle control means mounted at the fixed chassis and activated by the moving chassis to force the fixed blade to incline away from the moving chassis when the moving chassis is engaging the fixed chassis.

Further objects and advantages of the present invention will become more fully understood from the detailed description of the preferred embodiments given below in conjunction with the accompanying drawings, wherein:

DETAILED DESCRIPTIONS OF EMBODIMENTS

Figure 1:
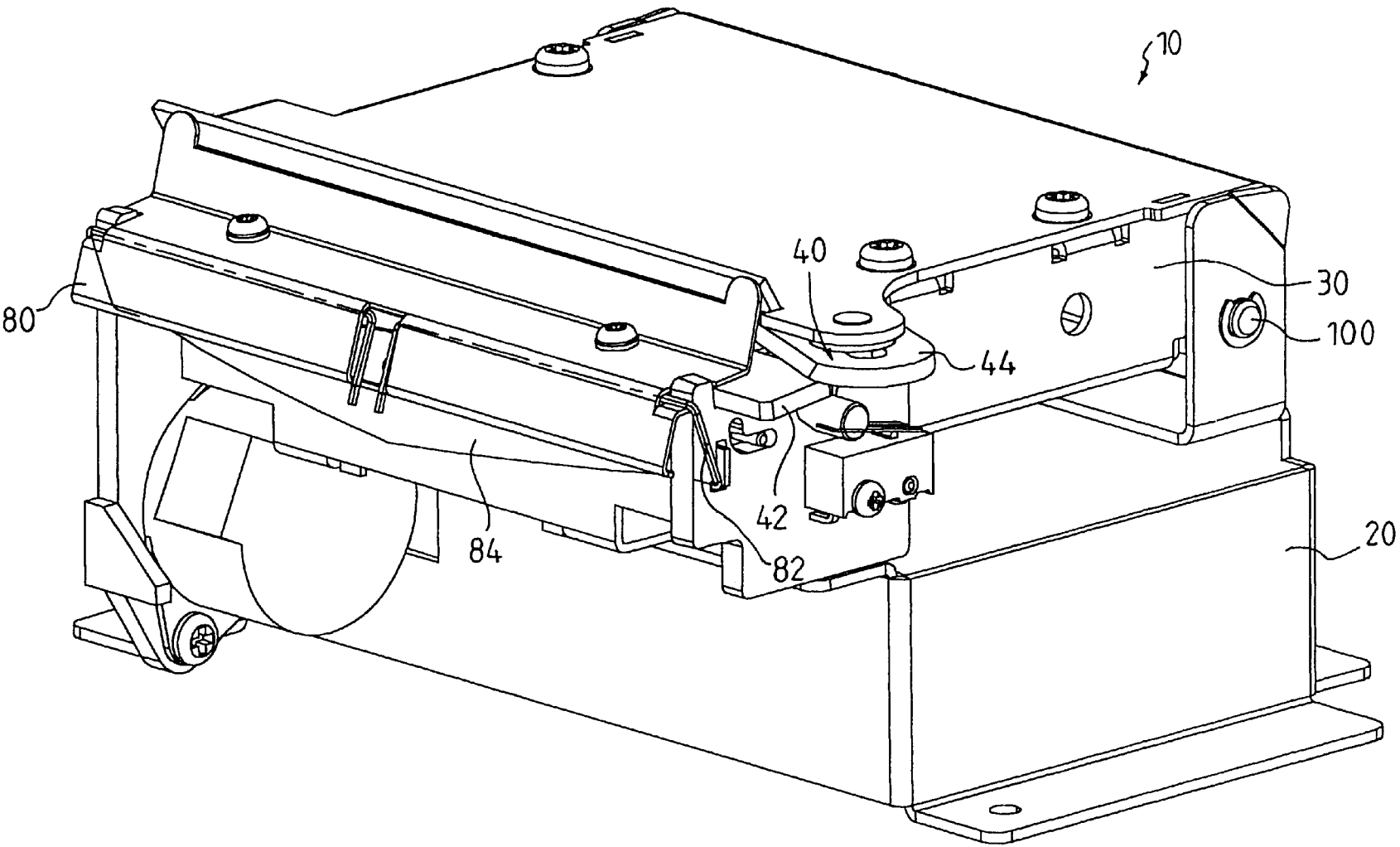
FIG. 1 is a perspective view showing the printing mechanism of this invention at its closed position.
Figure 2:
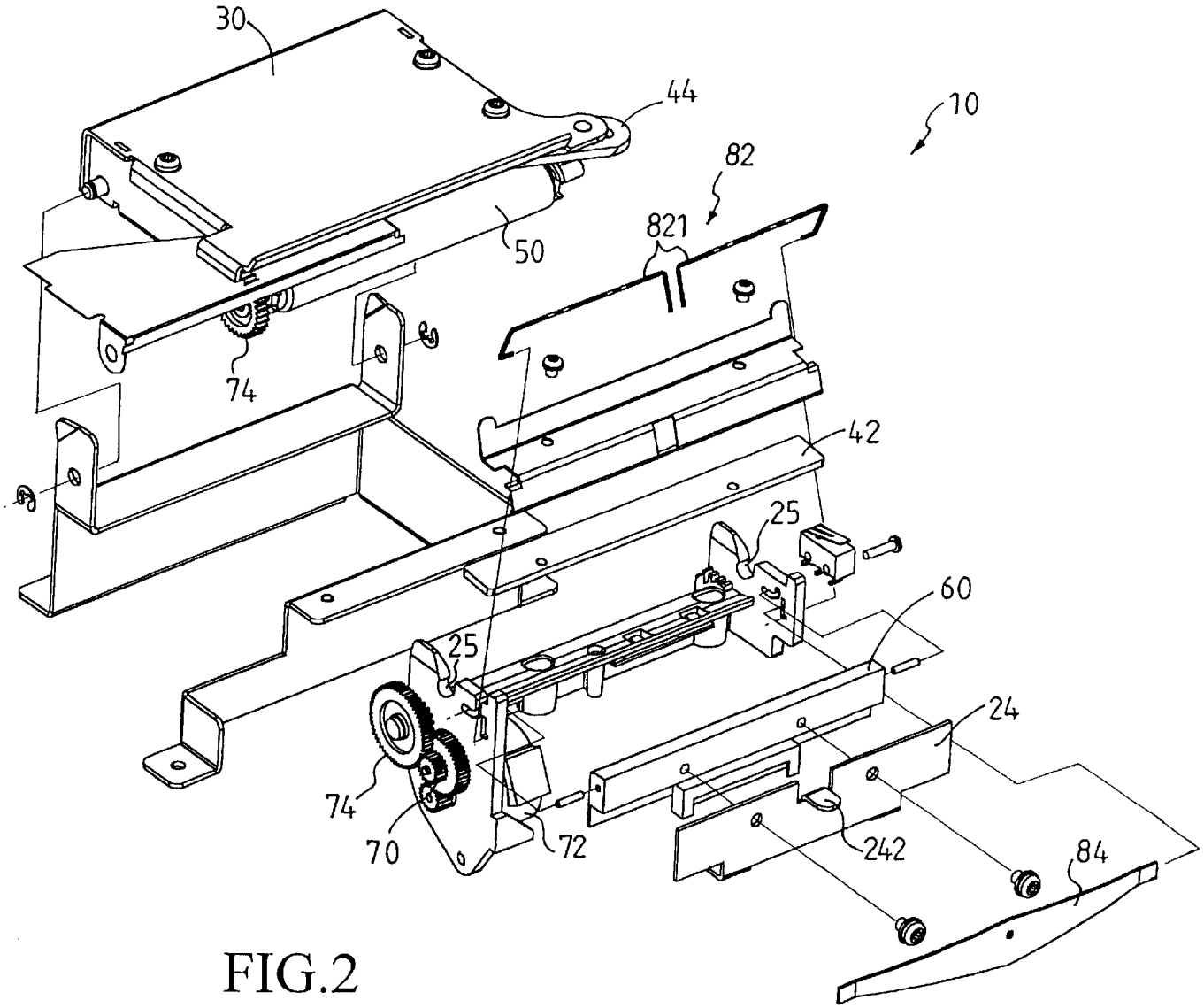
FIG. 2 is an exploded, perspective view showing the printing mechanism of FIG. 1.

FIG. 1 is a perspective view showing the printing mechanism 10 at its closed position. FIG. 2 is an exploded, perspective view showing the printing mechanism 10 of FIG. 1.

As shown in FIG. 1, the printing mechanism 10 includes a fixed chassis 20 to be mounted on a printer, the fixed chassis having a first edge and a second edge each having opposing ends; a moving chassis 30, having a first edge and a second edge each having opposing ends; a cutter 40; a paper drive roll 50; a thermal head 60; and driving means 70. The second edge of the fixed chassis 20 is pivotally mounted to the second edge of moving chassis 30 via a pivot 100 such that the moving chassis 30 is engageable with the fixed chassis 20 between an open position that is disengaged from the fixed chassis 20, and a closed position that is engaged with the fixed chassis 20, as shown in FIG. 1.

The cutter 40 includes a fixed blade 42 mounted at first edge of the fixed chassis 20, and a moving blade 44 being pivoted to a pivot end of the second edge of the moving chassis 30. After the moving chassis 30 engages to the fixed chassis 20, the moving blade 44 presses and urges the fixed blade 42 at a location outside the paper path so as to prevent from obstructing the paper motion.

In this embodiment, the paper drive roll 50 is mounted at the first edge of the moving chassis 30 beneath the moving blade 44 to travel along a notch 25 having a distorted L-shape and formed on each of the opposing ends of the first edge of the fixed chassis 20 via its spindle. The thermal head 60 is mounted at the first edge of the fixed chassis 20 beneath the fixed blade 42.

Figure 3:
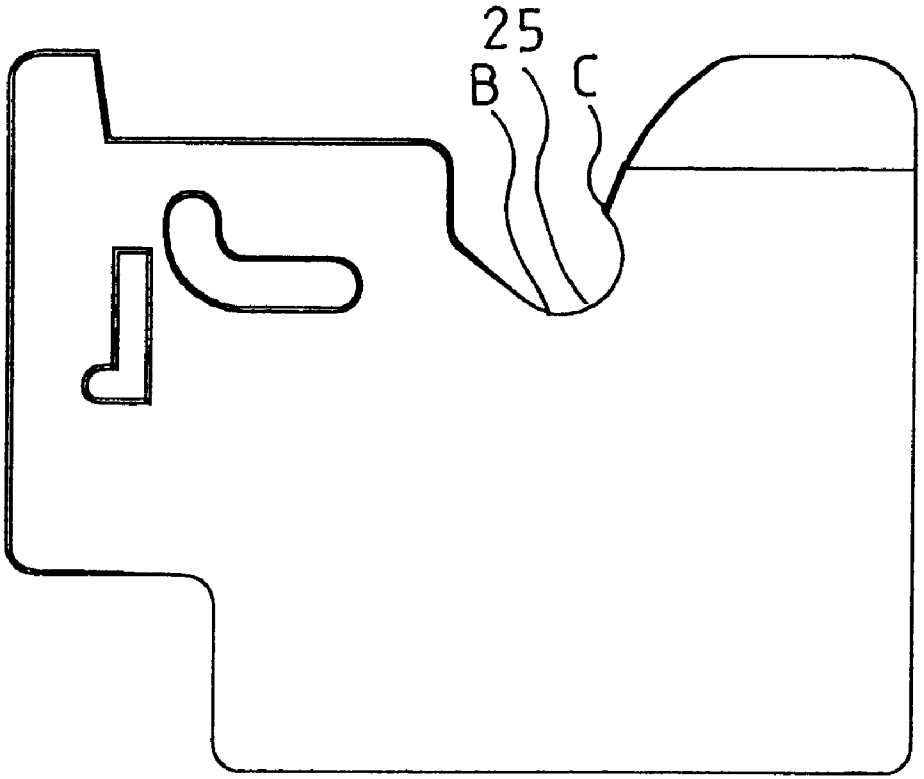
FIG. 3 is an enlarged view showing the notches along which the paper drive roll travels.

An enlarged view of the notches 25 is shown in FIG. 3. The notches 25 each include a bottom B and a turning corner C that is shaped like a hump. The turning corners C of the distorted L-shape notches 25 are where the paper drive roll 50 is closest to the thermal head 60, and where the thermal head 60 is in the traveling path of the paper drive roll 50.

In an alternative embodiment, the locations of the paper drive roll 50 and the thermal head 60 may be switched; that is, the paper drive roll 50 is to be mounted at the moving chassis 30 while the thermal head 60 is at the fixed chassis 20 so long as the thermal head 60 is in the path of the paper drive roll 50, or vice versa. The function for such an arrangement will be explained later.

Returning to FIG. 2, the driving means 70 may include a motor 72 and a gear set 74 for driving the paper drive roll 50 to subject paper rolling between the thermal head 60 and the paper drive roll 50 and then between the fixed blade 42 and moving blade 44.

To achieve the objects as previously stated, a restraining module 80 is provided at the printing mechanism 10. As shown in FIGS. 1 and 2, the restraining module 80 comprises: a first angle control means 82 mounted at the first edge of the fixed chassis 20; and a second angle control means 84 mounted at the first edge of the fixed chassis 20.

As best seen in FIGS. 1 and 2, the first angle control means 82 includes a pair of torsion springs 821 mounted on the opposing ends of the first edge of the fixed chassis 20 and to normally lever the fixed blade 42 to incline away from the fixed chassis 20.

Further, the second angle control means 84 is a spring plate mounting across the opposing ends of the fixed edge of the fixed chassis 20 alongside the thermal head 60. The spring plate 84, while being forced away from the fixed chassis 20 by external force, will overcome the force provided by the torsion springs 821 to lever the fixed blade 42 to incline towards the fixed chassis 20.

To allow better operation between the thermal head 60 and the spring plate 84, the thermal head 60 is mounted to a driving plate 24 of the fixed chassis 20. The driving plate 24 is further provided with a tail 242 extending towards the second angle control means 84 and being normally engaged with the second angle control means/spring plate 84.

Figure 4A:
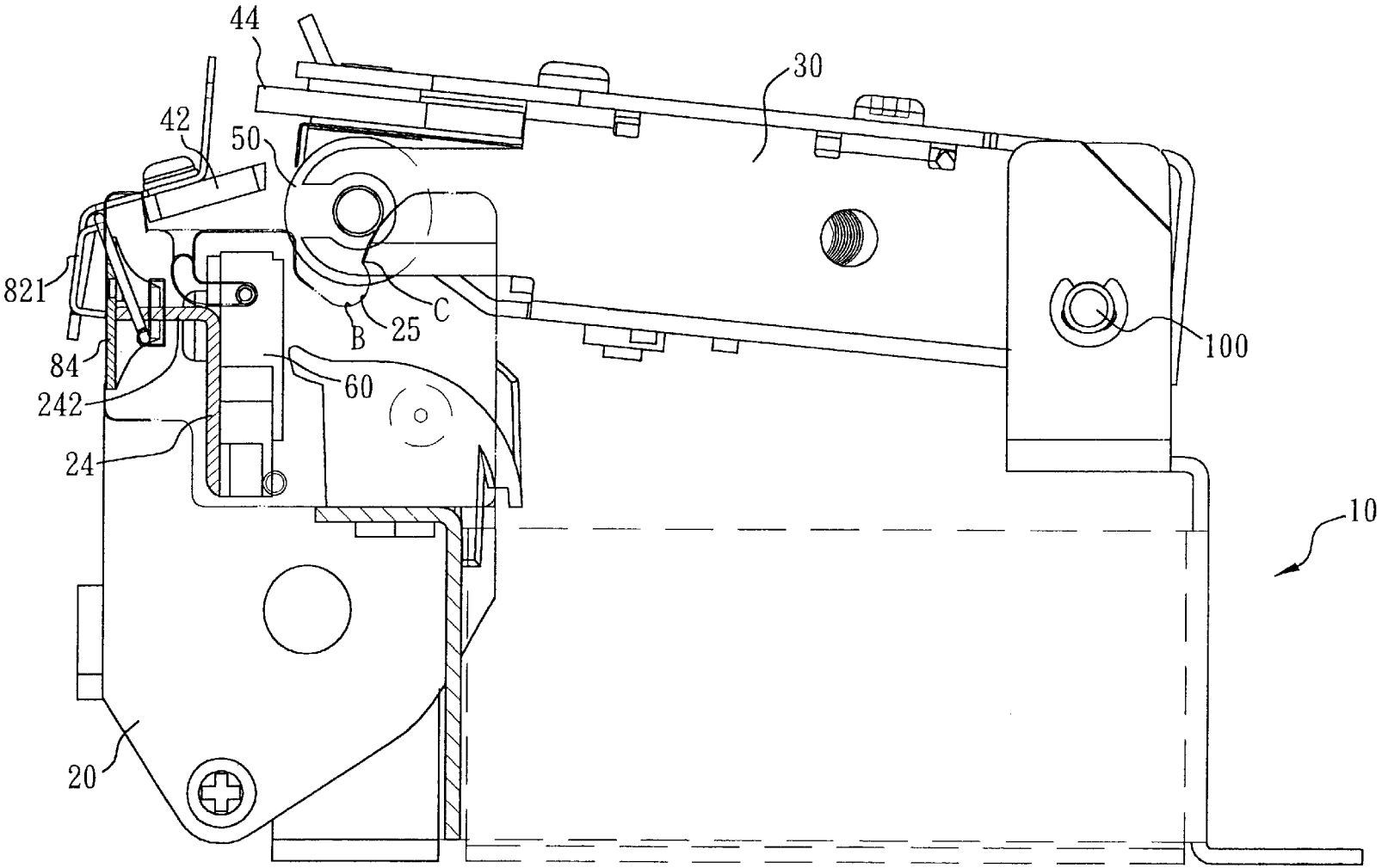
FIG. 4*a* is a cross-sectional view showing the relationships between the paper drive roll and thermal head, as well as that between the moving and fixed blades with the moving chassis at the open position.

To operate the restraining module 80, prior to the moving chassis 30 is engaged to the fixed chassis 20, the thermal head 60, as stated before, is in a path of the paper drive roll 50, and the first angle control means 82 normally forces the fixed blade 42 to incline away from the fixed chassis 20 while the tail 242 does not act on the second spring plate 84, as shown in FIG. 4*a*.

As one. intends to engage the moving chassis 30 to the fixed chassis 20, the moving chassis 30 is pivoted downwards such that the paper drive roll 50 gradually comes into contact with the thermal head 60 along the notches 25.

Figure 4B:
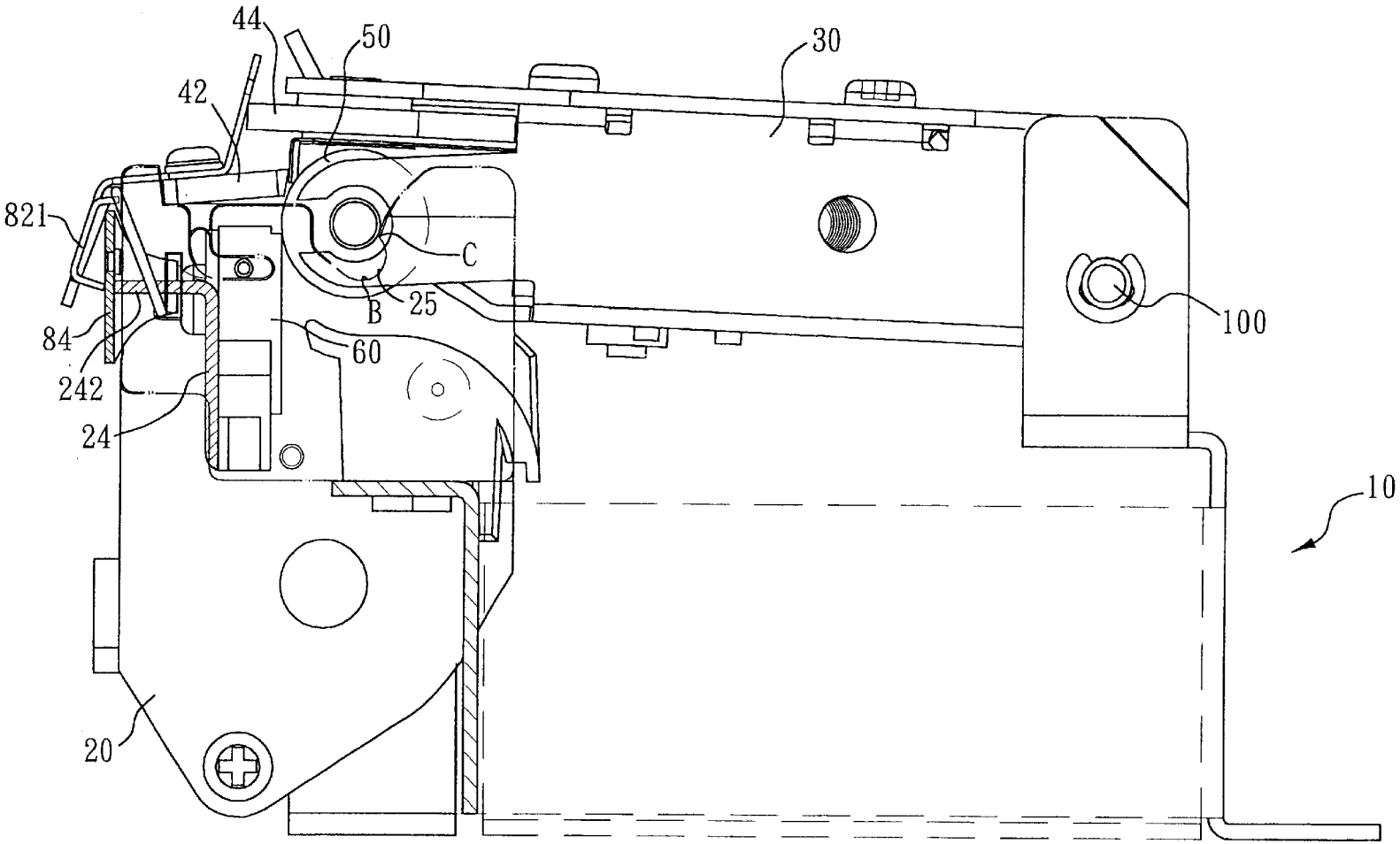
FIG. 4*b* is a cross-sectional view showing the relationships between the paper drive roll and thermal head, as well as that between the moving and fixed blades with the paper drive roll paper at the turning corner of the notches.

Because the paper drive roll 50 comes into contact with the thermal head 60 before the moving blade 44 with the fixed blade 42, prior to any contact between the moving blade 44 and the fixed blade 42, the paper drive roll 50 will start to urge the thermal head 60 while traveling along the notches 25. Once the paper drive roll 50 has reached the turning corners C of the notches 25, as shown in FIG. 4*b*, the paper drive roll 50 starts to drive the thermal head 60 to recede away from the path of the paper drive roll 50. At the same time, the thermal head 60 subjects the tail 242 to act on the spring plate 84 to overcome the force provided by the torsion springs 821 and to lever the fixed blade 42 to incline away from the moving blade 44.

Figure 4C:
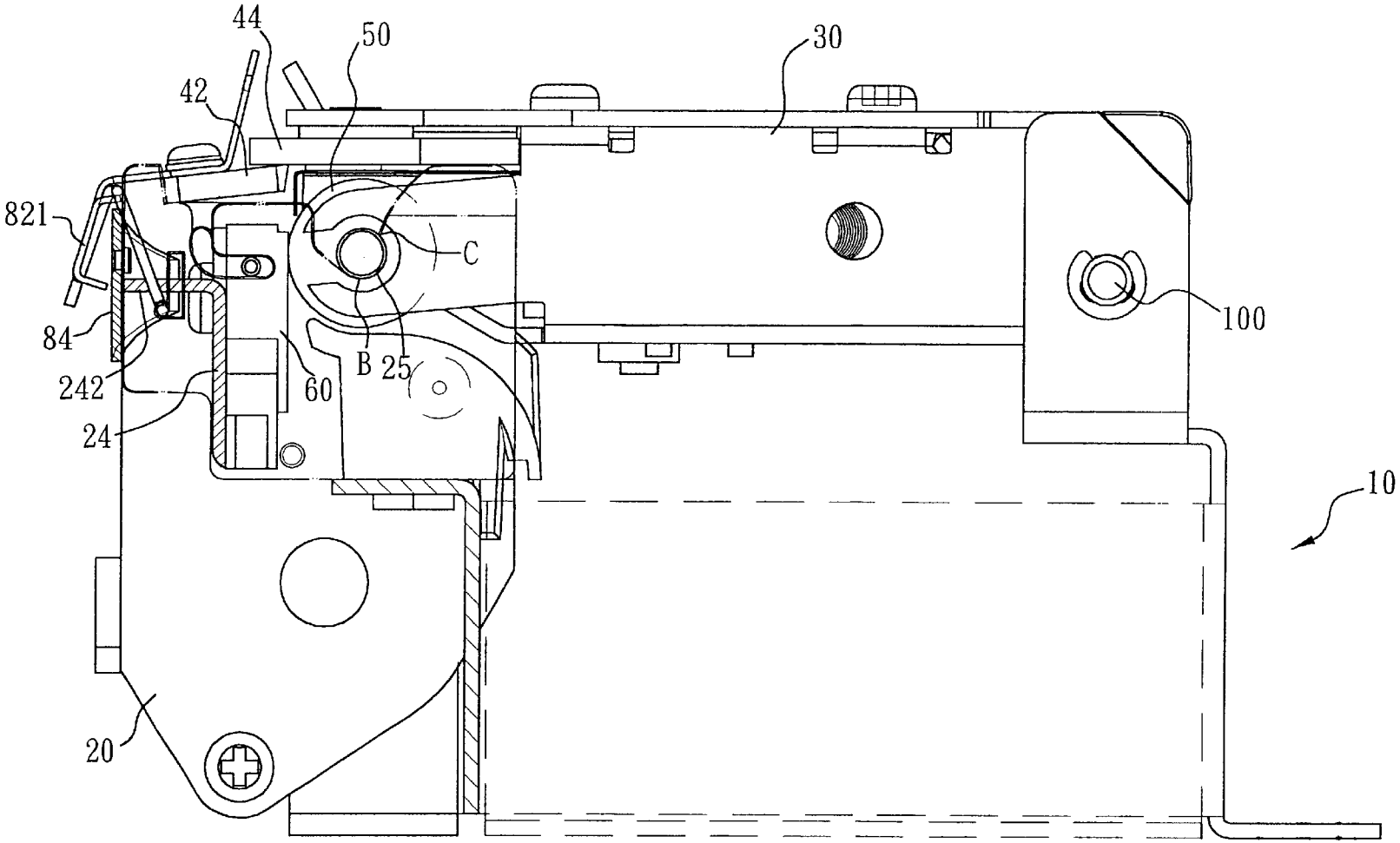
FIG. 4*c* is a cross-sectional view showing the relationships between the paper drive roll and thermal head, as well as that between the moving and fixed blades with the paper drive roll paper reaches the bottom of the notches.

As the paper drive roll 50 reaches the bottom B of the notches 25, as shown in FIG. 4*c*, that is, where the moving chassis 30 reaches the closed position, the paper drive roll 50 ,thermal head 60, driving plate 24, tail 242, and spring plate 84 move away from the first angle control means 82. At this time, the torsion springs 821 re-gain controls to lever the fixed blade 42 to incline away from the fixed chassis 20, that is, towards the moving chassis 30 to tightly engage with the moving blade 44.

As described above, the moving blade 44 is prevented from contacting the fixed blade 42 during the entire engagement processes between the moving chassis 30 and the fixed chassis 20, and only comes into contact with the fixed blade 42 at the end of the engagement processes. Such an engagement manner thus eliminates damages and scratches of either the moving blade 44 or the fixed blade 42 commonly found in the conventional printers. The second angle control means 84 helps the fixed blade 42 to maintain an appropriate gap with respect to the moving blade 44 when the moving chassis 30 is approaching the closed position so as to allow smooth engagement of the fixed and moving blades 42, 44, whereas the first angle control means 82 helps the fixed blade 42 to maintain a close relationship with the moving blade during the cutting operations so as to obtain a scissor-like motion between the two blades 42, 44.

Aforementioned explanation is directed to the description of the preferred embodiment according to the present invention. Various changes and implementations can be made by those skilled in the art without departing from the technical concept of the present invention. Since the present invention is not limited to the specific details described in connection with the preferred embodiment except those that may be within the scope of the appended claims, changes to certain features of the preferred embodiment without altering the overall basic function of the invention are contemplated.

What is claimed is:

1. A printer having: a fixed chassis mounted thereon; a moving chassis being engageable with the fixed chassis between an open position and a closed position; a cutter including a fixed blade mounted at the fixed chassis, and a moving blade being pivotally mounted to the moving chassis; a paper drive roll mounted at the moving chassis beneath the moving blade; a thermal head mounted at the fixed chassis beneath the fixed blade; and driving means driving the paper drive roll to subject paper rolling along a paper path formed between the thermal head and the paper drive roll, and the fixed blade and moving blade; and a restraining module for maintaining an appropriate gap between the fixed blade and the moving blade when the moving chassis is engaging the fixed chassis, characterized in that:

the thermal head is in a path of the paper drive roll;

the moving blade urges the fixed blade towards the fixed chassis when the moving chassis is at the closed position; and the restraining module comprises:

a first angle control means mounted at the fixed chassis normally forcing the fixed blade to incline away from the fixed chassis; and a second angle control means mounted at the fixed chassis and activated by the moving chassis to force the fixed blade to incline away from the moving chassis prior to the closed position when the moving chassis is engaging the fixed chassis;

whereby the fixed blade maintains an appropriate gap with respect to the moving blade when the moving chassis is approaching the closed position so as to allow smooth engagement of the fixed and moving blades.

2. The printer of claim 1, wherein: the fixed chassis has a first edge and a second edge each having opposing ends; the fixed blade, the thermal head, the first and the second angle control means are provided at the first edge of the fixed chassis; and the moving chassis has a first edge and a second edge each having opposing ends, the second edge of the fixed chassis being pivotally mounted to the second edge of moving chassis such that the moving chassis is engageable with the fixed chassis; the paper drive roll is provided at the first edge of the moving chassis.

3. The printer of claim 2, wherein the fixed blade is levered at the first edge of the fixed chassis, and the first angle control means includes a pair of torsion springs mounted on the opposing ends of the first edge of the fixed chassis and normally levering the fixed blade to incline away from the fixed chassis.

4. The printer of claim 2, wherein the second angle control means includes a spring plate mounting across the opposing ends of the first edge of the fixed chassis alongside the thermal head, and a notch on each of the opposing ends of the fixed chassis for receiving a spindle of the paper drive roll therein, such that the spring plate is activated by the thermal head to force the fixed blade to incline away from the moving blade when the paper drive roll of the moving chassis travels along the notches to engage the thermal head of the fixed chassis.

5. The printer of claim 4, wherein the notches are each configured to a distorted L-shape and include a bottom and a turning comer that is shaped like a hump, the turning comers being where the paper drive roll is closest to the thermal head when the paper drive roll of the moving chassis travels along the notches.

6. The printer of claim 1, wherein the moving blade presses and urges the fixed blade at a location outside the paper path.

* * * * *